US005651937A

United States Patent [19]

Descaves

[11] Patent Number: 5,651,937

[45] Date of Patent: Jul. 29, 1997

[54] AUSTENITIC STAINLESS STEEL, IN PARTICULAR FOR MAKING WIRE

[75] Inventor: Frédéric Descaves, Albertville, France

[73] Assignee: Ugine Savoie (Societe Anonyme), Ugine, France

[21] Appl. No.: 635,579

[22] Filed: Apr. 22, 1996

[30] Foreign Application Priority Data

Apr. 21, 1995 [FR] France ..... 95 04782

[51] Int. Cl.[6] ..... C22C 38/40

[52] U.S. Cl. ..... 420/41; 420/49; 420/52; 420/57

[58] Field of Search ..... 420/41, 43, 45, 420/46, 49, 52, 56, 57, 58

[56] References Cited

U.S. PATENT DOCUMENTS 4,434,006 2/1984 Kato et al. ..... 420/41

FOREIGN PATENT DOCUMENTS 55-122858 9/1980 Japan ..... 420/41

*Primary Examiner*—Deborah Yee

*Attorney, Agent, or Firm*—Oblon, Spivak, McClelland, Maier & Neustadt, P.C.

[57] ABSTRACT

Austenitic stainless steel for the production of wire, which can be used in the field of drawing to a diameter of less than 0.3 mm and in the field of producing parts subjected to wear.

6 Claims, 1 Drawing Sheet

AUSTENITIC STAINLESS STEEL, IN PARTICULAR FOR MAKING WIRE

BACKGROUND OF THE INVENTION

Field of the Invention

The present invention relates to an austenitic stainless steel, particularly useful for making wire, having an inclusional purity well suited for use in the field of drawing wire of diameter less than 0.3 mm and in the field of producing parts subjected to wear.

The term stainless steels is used herein to denote iron alloys containing at least 10.5% of chromium. Other elements are involved in the composition of steels with the purpose of altering their structure and their properties.

Austenitic stainless steels have a defined composition. The austenitic structure is ensured after transformation by a heat treatment of the hyperquenching type.

DISCUSSION OF THE BACKGROUND

From the metallurgical point of view, it is known that some alloy elements involved in the composition of steels promote the appearance of the ferrite phase with a body-centered cubic type metallographic structure. These elements are termed alpha-gens. They include chromium, molybdenum and silicon.

Other elements, termed gamma-gens, promote the appearance of the austenitic phase with a face-centered cubic type metallographic structure. These elements include carbon, nitrogen, manganese, copper and nickel.

In, for example, the field of drawing, it is known that the stainless steel used for obtaining a so-called thin wire of diameter less than 0.3 mm should not contain inclusions whose size leads to fracture of the wire during drawing.

When austenitic stainless steels are made, as in the case of all other steels made using conventional means economically suited to mass production, the presence of sulfide or oxide type inclusions is systematic and unavoidable. This is because, in the liquid state, stainless steels may contain in solution, as a result of the manufacturing processes, oxygen and sulfur in amounts of less than $100 \cdot 10^{-4}\%$. During cooling of the steel in the liquid or solid state, the solubility of the oxygen and sulfur elements decreases and the energy of formation of oxides or sulfides is obtained. Inclusions then appear which are formed, on the one hand, by compounds of the oxide type containing oxygen atoms and alloy elements which react readily with oxygen, such as calcium, magnesium, aluminum, silicon, manganese and chromium, and, on the other hand, compounds of the sulfide type containing sulfur atoms and alloy elements which react readily with sulfur, such as manganese, chromium, calcium and magnesium. Inclusions consisting of mixed compounds of the oxysulfide type may also appear.

EP-A-0,567,365 relates to an austenitic steel containing, in particular, copper and calcium combined with oxygen in a high Ca/O ratio to form malleable oxides. These oxides have compositions which lie on the $Al_2O_3$—$SiO_2$—CaO diagram, in the vicinity of the anorthite, gehlenite and pseudo-wollastonite triple point. In this document, which relates to a steel with improved machinability, the oxides are introduced intentionally in number.

It is possible to reduce the quantity of oxygen contained in stainless steel by using powerful reducers such as magnesium, aluminum, calcium, titanium or a combination of several thereof, but all these reducers lead to the creation of inclusions rich in MgO, $Al_2O_3$, CaO or $TiO_2$ which are in the form of hard crystallized refractories which are indeformable under the stainless steel rolling conditions. The presence of these inclusions leads, for example, to incidents during drawing and fatigue fractures in the products made using the stainless steel.

SUMMARY OF THE INVENTION

The object of the invention is the provision of an austenitic stainless steel having selected inclusional purity, which steel can be beneficially used, in particular, in the field of drawing to a diameter of less than 0.3 mm and in the field of producing parts subjected to wear. Methods of using this steel and the articles made therewith are also objects of the invention.

The above objects of of the invention are provided by an austenitic stainless steel which comprises the following elements by weight based on total weight:

carbon$\leqq 200 \cdot 10^{-3}\%$
nitrogen$\leqq 200 \cdot 10^{-3}\%$
$0.3\% \leqq$ manganese$\leqq 4\%$,
$14\% \leqq$ chromium$\leqq 23\%$
$5\% \leqq$ nickel$\leqq 17\%$,
$0.3\% \leqq$ silicon$\leqq 2\%$,
sulfur$\leqq 10 \cdot 10^{-3}\%$,
$50 \cdot 10^{-4}\% \leqq$ total oxygen$\leqq 120 \cdot 10^{-4}\%$,
$5 \cdot 10^{-4}\% \leqq$ aluminum$\leqq 20 \cdot 10^{-4}\%$
magnesium$\leqq 2 \cdot 10^{-4}\%$
$0.1 \cdot 10^{-4}\% \leqq$ calcium$\leqq 5 \cdot 10^{-4}\%$
titanium$\leqq 5 \cdot 10^{-3}\%$
the substantial remainder preferably iron
impurities inherent in the manufacturing, and in which oxide inclusions present have, in the form of a vitreous mixture, the following proportions by weight:

$40\% \leqq SiO_2 \leqq 60\%$
$5\% \leqq MnO \leqq 50\%$
$1\% \leqq CaO \leqq 30\%$
$0.1\% \leqq MgO \leqq 20\%$
$3\% \leqq Al_2O_3 \leqq 25\%$
$0.1\% \leqq Cr_2O_3 \leqq 10\%$ Preferred characteristics of the invention include one, some or all of the following:

- The composition of the steel comprises less than $5 \cdot 10^{-3}\%$ of sulfur.
- The composition of the steel comprises less than 3% of molybdenum
- The composition of the steel furthermore comprises less than 3% of copper
- The steel contains in number, after hot rolling to a diameter of greater than 5 mm, fewer than 5 oxide inclusions of thickness greater than 10 μm for a surface area of 1000 $mm^2$.
- The steel contains in number, after hot rolling to a diameter of greater than 5 mm, fewer than 10 sulfide inclusions of thickness greater than 5 μm for a surface area of 1000 $mm^2$.

BRIEF DESCRIPTION OF THE DRAWINGS

The following description and the appended drawings, all given by way of nonlimiting example, will further explain the invention.

DETAILED DESCRIPTION OF PREFERRED EMBODIMENTS

Figure 1:
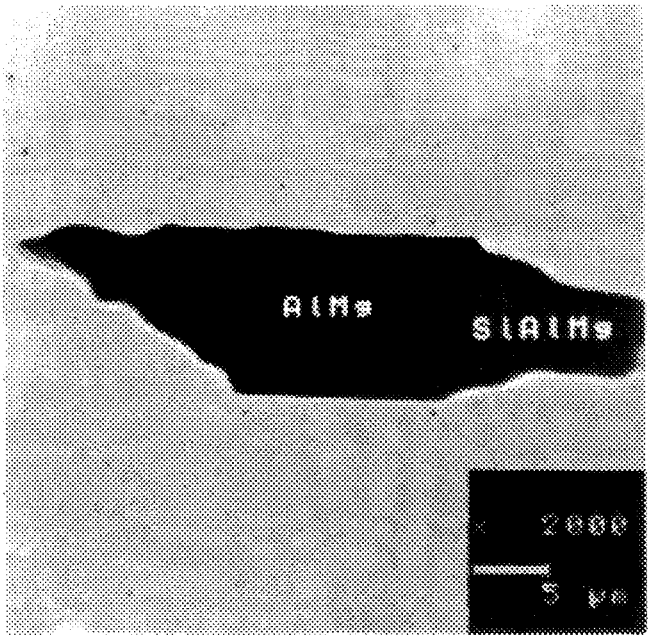
FIGS. 1 and 2 present an image of an example of a thick and relatively undeformed inclusion and an image of an example of inclusions which are contained in a steel according to the invention, respectively.

The steel according to the invention preferably contains, in its composition by weight, less than $200 \cdot 10^{-3}$% of carbon, less than $200 \cdot 10^{-3}$% of nitrogen, from 0.3% to 4% of manganese, from 14% to 23% of chromium, from 5% to 17% of nickel, from 0.3% to 2% of silicon, less than $10 \cdot 10^{-3}$% of sulfur, from $50 \cdot 10^{-4}$% to $120 \cdot 10^{-4}$% of total oxygen, from $5 \cdot 10^{-4}$% to $20 \cdot 10^{-4}$% of aluminum, less than $2 \cdot 10^{-4}$% of magnesium, from $0.1 \cdot 10^{-4}$% to $5 \cdot 10^{-4}$% of calcium, and less than $5 \cdot 10^{-3}$% of titanium.

Carbon, nitrogen, chromium, nickel, manganese and silicon are elements which are believed to make it possible to obtain an austenitic stainless steel.

The manganese, chromium and sulfur contents, expressed as a proportion, are believed to give rise to deformable sulfides with well-determined compositions.

According to the invention, the composition amounts of the silicon and manganese elements, expressed as a proportion, ensure the presence of inclusions of the silicate type, which are rich in $SiO_2$ and contain a non-negligible quantity of MnO.

Molybdenum may be added to the composition of the austenitic stainless steel in order to improve its corrosion resistance. Copper may also be added to the composition of the steel according to the invention, because it improves the cold deformation properties and thereby stabilizes the austenite. However, the copper content is limited to 3% in order to avoid difficulties of hot conversion because copper substantially lowers the upper temperature limit for reheating the steel before rolling.

According to the invention, the total oxygen, aluminum and calcium amounts make it possible to obtain inclusions of the manganese silicate type, containing a non-zero fraction of $Al_2O_3$ and of CaO. In particular, the aluminum and calcium contents are greater than $0.1 \cdot 10^{-4}$% so that the desired inclusions contain more than 1% of CaO and more than 3% of $Al_2O_3$.

According to the invention, the preferred values of the total oxygen contents are between 50 ppm and 120 ppm.

For a total oxygen content of less than 50 ppm, the oxygen fixes the magnesium, calcium and aluminum elements and does not form oxide inclusions rich in $SiO_2$ and MnO.

With a total oxygen content of greater than 120 ppm there will be, in the composition of the oxides, more than 10% of $Cr_2O_3$, which promotes crystallization, which is desirable to avoid.

The calcium content of the invention composition is less than or equal to $5 \cdot 10^{-4}$%, so that, it is believed, the desired inclusions do not contain more than 30% of CaO. The aluminum content is less than or equal to $20 \cdot 10^{-4}$%, in order to, it is believed, prevent the desired inclusions from containing more than 25% of $Al_2O_3$, which also promotes crystallization.

It is possible, after having produced a steel containing inclusions of the oxide and sulfide type using a conventional and economical process, to refine it in order to eliminate these inclusions by using slow remelting processes with poor economic viability, such as vacuum argon remelting or electro-slag remelting. These remelting processes allow only partial elimination of the inclusions already present, by settling into the liquid pool, without altering their nature and their composition.

As mentioned above, the invention preferably relates to an austenitic stainless steel containing inclusions of intentionally obtained selected composition, the composition being related with the overall composition of the steel in such a way that the physical properties of these inclusions promote their deformation during hot conversion of the steel.

According to the invention, the austenitic stainless steel preferably contains inclusions of determined composition which have their softening point close to the rolling temperature of the steel and such as to inhibit the appearance of crystals harder than the steel at the rolling temperature, such as, in particular, the defined compounds $SiO_2$, in tridymite, cristobalite or quartz form; $3CaO—SiO_2$; CaO; MgO; $Cr_2O_3$; anorthite, mullite, gehlenite, corundum, spinel of the type $Al_2O_3—MgO$ or $Al_2O_3—Cr_2O_3—MnO—MgO$; $Cao—Al_2O_3$; $CaO—6Al_2O_3$; $CaO—2Al_2O_3$, $TiO_2$.

According to the invention, the steel mainly contains oxide inclusions of compositions such that they form a vitreous or amorphous mixture throughout the successive operations of forming the steel. The viscosity of the selected inclusions is sufficient for the growth of crystallized oxide particles in the resulting inclusions of the invention to be completely inhibited because there is little short-distance diffusion and convective displacements are very limited within an oxide inclusion. These inclusions which remain vitreous in the temperature range of the hot treatments of the steel also have a hardness and a modulus of elasticity which are lower than crystallized inclusions of corresponding composition. The inclusions can thus still be deformed, compressed and extended during, for example, the drawing operation, and the stress concentration in the vicinity of the inclusions is greatly decreased, which significantly lessens the risk of, for example, the appearance of fatigue cracks or drawing fractures.

According to the invention, the austenitic stainless steel preferably contains oxide inclusions of defined composition such that their viscosity in the temperature range of the hot rolling of the steel is not too great. The yield stress of the inclusion is therefore much less than that of the steel under the hot rolling conditions, during which the temperatures are generally between 800° C. and 1350° C. The oxide inclusions thus deform at the same time as the steel during the hot rolling, and after rolling these inclusions are therefore perfectly elongated and very thin, which makes it possible to avoid any problem of fracture during, for example, a drawing operation.

According to the invention, the inclusions described above may be produced with the conventional and highly productive manufacturing means in an electric steel plant for stainless steels such as an electric furnace, AOD or VOD converter, batch and continuous-casting metallurgy. With such conventional manufacturing and casting methods described above, the size distribution of the inclusions over the raw casting product is relatively independent of their composition. The same sizes and the same distributions of inclusions are therefore found in these steels before hot rolling.

According to the invention, the oxide inclusions below, which have the favorable properties described, are composed of a vitreous mixture of $SiO_2$, MnO, CaO, $Al_2O_3$, MgO and $Cr_2O_3$, and, optionally, of trace FeO and/or $TiO_2$, in the following proportions by weight:

$40\% \leqq SiO_2 \leqq 60\%$ $5\% \leqq MnO \leqq 50\%$ $1\% \leqq CaO \leqq 30\%$ $0.1\% \leqq MgO \leqq 20\%$ $3\% \leqq Al_2O_3 \leqq 25\%$ $0.1\% \leqq Cr_2O_3 \leqq 10\%$ If the $SiO_2$ content is less than 40%, the viscosity of the oxide inclusions is too low and the growth mechanism of oxide crystals is not inhibited. If SiO2 is greater than 60%, very hard and harmful particles of silica in the form of tridymite or cristobalite or quartz are formed.

The MnO content, between 5% and 50%, permits a great reduction in the softening point of the oxide mixture containing, in particular, $SiO_2$, CaO and $Al_2O_3$, and promotes the creation of inclusions which remain in a vitreous state under the rolling conditions of the steel according to the invention.

If the CaO content is less than 1%, MnO—$Al_2O_3$ or mullite crystals are formed. When the CaO content is greater than 30%, crystals of CaO—$SiO_2$ or (Ca, Mn)O—$SiO_2$ are then formed.

If the MgO content is greater than 20%, crystals of MgO; 2MgO—$SiO_2$; MgO—$SiO_2$; $Al_2O_3$—MgO are formed, which are extremely hard phases.

If $Al_2O_3$ is less than 3%, wollastonite crystals are formed, and when $Al_2O_3$ is greater than 25%, crystals of mullite, anorthite, corundum, spinels, in particular of type $Al_2O_3$—MgO or $Al_2O_3$—$Cr_2O_3$—MgO—MnO or of aluminates of the type CaO—$6Al_2O_3$ or CaO—$2Al_2O_3$ or CaO—$Al_2O_3$ or gehlenite appear.

With more than 10% of $Cr_2O_3$, hard crystals of $Cr_2O_3$ or $Al_2O_3$—$Cr_2O_3$—MgO—MnO, CaO—$Cr_2O_3$, MgO—$Cr_2O_3$ also appear.

According to one form of the invention, the sulfur content is preferably less than 0.010% in order to obtain sulfide inclusions with a thickness of no greater than 5 μm in the rolled product. In fact, inclusions of manganese and chromium sulfide type are perfectly deformable under the following conditions:

$5\% < Cr < 30\%$ $30\% < Mn < 60\%$ $35\% < S < 45\%$

The inclusions of oxide and sulfide type are generally considered as detrimental with regard to the working properties in the field of thin wire drawing and in the field of fatigue strength, in particular in flexion and/or in torsion. It is typical to characterize the concentration of inclusions of oxide or sulfide type by observing a polished section with direction along the rolling on a hot-rolled machine wire of diameter between 5 and 10 mm. The result of this characterization, carried out according to various standards depending on the final use, is termed the inclusional purity.

For an inclusion observed on a polished rolled-wire section, its length and its thickness are measured. Then a shape factor formed by the ratio of length to thickness is defined. For an inclusion which is very highly deformed during the rolling operations, the shape factor is in general very high, that is to say that it may be as much as 10 or 20, and the inclusion is consequently extremely thin. In contrast, an inclusion which does not deform or undergoes little deformation is characterized by a low shape factor, that is to say on the order of 1, and therefore the thickness of the inclusion remains high and of the same order of magnitude as the size of the original inclusion in the raw casting product. The thickness of each inclusion observed in the rolled wire will consequently be adopted throughout the rest of the description as a simple and effective characterization criterion for the working properties of the rolled wire.

EXAMPLES

Figure 2:
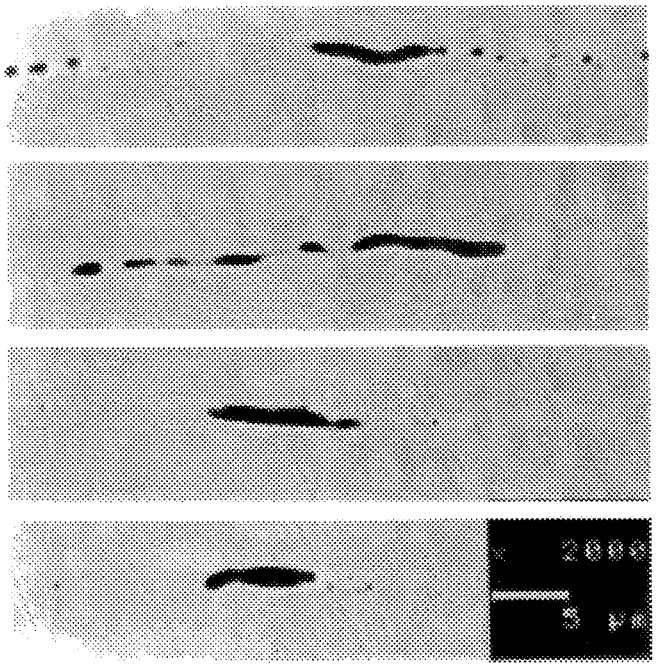

FIGS. 1 and 2 respectively present, in a polished section of a rolled wire of diameter of 5.5 mm, an example of a very thick and relatively undeformed inclusion and an example of thin and very highly deformed inclusions contained in the steel according to the invention.

FIG. 1 shows a so-called two-phase mixed inclusion, consisting of an indeformable crystallized central part of $Al_2O_3$—MgO type, denoted AlMg in the figure, and two end parts, denoted SiAlMg in the figure, consisting of a not very deformable phase rich in $SiO_2$, $Al_2O_3$ and MgO. This inclusion has a thickness of 11 micrometers, a length of 40 micrometers and is particularly detrimental for applications of drawing or producing parts subjected to wear.

FIG. 2 presents four examples of inclusions with thicknesses of less than 2 micrometers, and of variable length, such as those contained in the steel according to the invention.

The latter inclusions have no detrimental effect on applications of thin wire drawings with a diameter of less than 0.3 mm or of parts subjected to wear, such as springs, tire reinforcements, etc.

The inclusional characteristics are defined by counting the number of inclusions with a thickness equal to or greater than a given dimension for a sample surface area of 1000 $mm^2$.

Tables 1 and 2 below present steels showing the influence of the composition of the steel and of the composition of the oxide inclusions on the number of inclusions of given thickness.

TABLE 1

| STEEL | A | B | C | D | E | F | G |
|---|---|---|---|---|---|---|---|
| % C | 0.093 | 0.065 | 0.067 | 0.093 | 0.060 | 0.055 | 0.083 |
| % N | 0.030 | 0.045 | 0.045 | 0.026 | 0.041 | 0.056 | 0.040 |
| % Si | 1.81 | 0.49 | 0.54 | 1.75 | 0.48 | 0.56 | 0.75 |
| % Mn | 1.32 | 0.26 | 0.30 | 1.25 | 0.58 | 0.53 | 1.08 |
| % Cr | 17.65 | 18.46 | 18.32 | 17.60 | 18.27 | 18.24 | 17.95 |
| % Ni | 7.85 | 8.49 | 8.47 | 7.75 | 8.61 | 8.57 | 8.30 |
| % Mo | 0.71 | 0.10 | 0.17 | 0.73 | 0.24 | 0.28 | 0.33 |
| % Cu | 0.22 | 0.32 | 0.33 | 0.15 | 0.48 | 0.51 | 0.25 |
| to ppm | 25 | 40 | 48 | 28 | 129 | 138 | 65 |
| Al ppm | 43 | 10 | 8 | 26 | 25 | 13 | 18 |
| Ca ppm | 9 | 13 | 2 | 1 | 54 | 11 | 2 |
| Mg ppm | 1 | 1 | 1 | 3 | 2 | 1 | 1 |
| Ti ppm | 28 | 32 | 45 | 62 | 56 | 36 | 39 |
| S ppm | 31 | 25 | 46 | 40 | 279 | 286 | 126 |
| nature of the inclusions | | | | | | | |
| % SiO2 | 4 | 36 | 39 | 48 | 39 | 61 | 42 |
| % CaO | 3 | 24 | 16 | 2 | 36 | 2 | 13 |
| % MnO | 1 | 2 | 8 | 6 | 1 | 20 | 22 |
| % Al2O3 | 69 | 33 | 25 | 2 | 20 | 2 | 15 |
| % MgO | 21 | 2 | 4 | 40 | 2 | 1 | 3 |
| % Cr2O3 | 2 | 3 | 8 | 2 | 2 | 14 | 5 |
| Inclusion count on hot-rolled machine wire of diameter 5.5 mm | | | | | | | |
| Count of number of sulfides with thickness >5 m per 1000 mm2 | 0 | 0 | 0 | 0 | 71 | 98 | 17.6 |
| Count of number of oxides with thickness >10 m per 1000 mm2 | 13.9 | 8 | 6 | 6.1 | 39 | 19 | 3.5 |

TABLE 2

| STEEL | H | I | J | K | L | M | N | O |
|---|---|---|---|---|---|---|---|---|
| % C | 0.069 | 0.088 | 0.079 | 0.079 | 0.075 | 0.078 | 0.081 | 0.099 |
| % N | 0.045 | 0.030 | 0.035 | 0.039 | 0.048 | 0.058 | 0.056 | 0.034 |
| % Si | 0.51 | 1.71 | 0.78 | 0.83 | 0.69 | 0.63 | 0.66 | 0.68 |
| % Mn0.32 | 1.29 | 1.05 | 0.96 | 0.74 | 0.70 | 0.72 | 0.85 | |
| % Cr | 18.39 | 17.75 | 17.80 | 17.60 | 18.52 | 18.52 | 18.50 | 17.65 |
| % Ni | 8.40 | 7.85 | 8.36 | 8.24 | 8.86 | 8.87 | 8.85 | 7.82 |
| % Mo | 0.17 | 0.69 | 0.29 | 0.17 | 0.15 | 0.17 | 0.15 | 0.32 |
| % Cu | 0.34 | 0.21 | 0.28 | 0.21 | 0.34 | 0.36 | 0.35 | 0.25 |
| to ppm | 52 | 51 | 70 | 65 | 53 | 71 | 50 | 95 |
| Al ppm | 9 | 19 | 17 | 16 | 12 | 9 | 11 | 9 |
| Ca ppm | 5 | 1 | 2 | 2 | 2 | 2 | 2 | 2 |
| Mg ppm | 1 | 1 | 1 | 1 | 1 | 1 | 1 | |
| 1 | | | | | | | | |
| Ti ppm | 35 | 15 | 22 | 23 | 30 | 18 | 25 | 23 |
| S ppm | 8 | 37 | 35 | 31 | 50 | 35 | 37 | 30 |
| nature of the inclusions | | | | | | | | |
| % SiO2 | 45 | 54 | 45 | 46 | 47 | 49 | 48 | 50 |
| % CaO | 15 | 2 | 11 | 2 | 17 | 1 | 14 | 4 |
| % MnO | 10 | 14 | 25 | 42 | 8 | 38 | 11 | 30 |
| % Al2O3 | 22 | 7 | 12 | 5 | 24 | 3 | 18 | 7 |
| % MgO1 | 18 | 2 | 0.1 | 2 | 1 | 3 | 1 | |
| % Cr2O3 | 7 | 4 | 5 | 5 | 2 | 8 | 3 | 8 |
| Inclusion count on hot-rolled machine wire of diameter 5.5 mm | | | | | | | | |
| Count of number of sulfides with thickness >5 m per 1000 mm2 | 0 | 0 | 0 | 0 | 0 | 0 | 0 | 0 |
| Count of number of oxides with thickness >10 m per 1000 mm2 | 3.5 | 2.4 | 2.6 | 3.1 | 1.2 | 0 | 1.2 | 0.5 |

Table 1 presents compositions of steels having unsatisfactory quality and Table 2 presents steel compositions according to the invention having a remarkable inclusional purity.

The inclusional characteristics are manifested by the fact of the presence over a sampled area of 1000 $mm^2$ of fewer than 5 oxide inclusions of thickness greater than 10 μm. The sulfide inclusions are, in number, fewer than 10 having a thickness of more than 5 μm, for an area of 1000 $mm^2$.

Steel A has a low total oxygen content and a high aluminum content. Because of this, the inclusions seen in the steel are depleted in $SiO_2$ and MnO, and are very rich in $Al_2O_3$ and MgO, of crystallized $Al_2O_3$—MgO spinel type. This is manifested by the presence, in the hot-rolled wire, of numerous inclusions of thickness greater than 10 μm, i.e. approximately 14 inclusions per 1000 $mm^2$.

Steel B has a low total oxygen content and a high calcium content. Despite an acceptable aluminum content, the observed inclusions contain too much $Al_2O_3$ and this is manifested, on the hot-rolled wire, by the presence of thick inclusions.

Steel C has a fairly low oxygen content, whereas the other elements such as aluminum, calcium and magnesium are in acceptable contents. This leads to the observation of inclusions which contain too little $SiO_2$. It is furthermore noted that the quantity of $Al_2O_3$ is of the order of 25%. The observed inclusions are not perfectly deformable under the rolling conditions and a consequent number of relatively undeformed inclusions is still observed in the rolled wire.

Steel D has, like steel C, a low total oxygen content but a high aluminum and magnesium content. Inclusions rich in $SiO_2$ and MgO are observed in the steel, which inclusions are not sufficiently deformable.

Steel E has a high sulfur content, which causes the appearance of very many relatively undeformed sulfides. It furthermore has a high oxygen, aluminum and calcium content. This leads to the appearance of inclusions containing little $SiO_2$, much CaO and very little MnO. These inclusions are not very deformable and are numerous.

Steel F also has high sulfur and oxygen contents, but the aluminum and calcium contents are fairly low. In this steel, the inclusions are rich in $SiO_2$ and in $Cr_2O_3$, which leads to the appearance of very hard $Cr_2O_3$ crystals and viscous $SiO_2$ phases.

Steel G has a high sulfur content, which is manifested by the appearance of numerous sulfides. Furthermore, the other contents in the composition are in acceptable intervals and the oxide inclusions obtained are of vitreous nature in the wire and are deformable as in the steel according to the invention.

In the examples of Table 2 according to the invention, when the aluminum content is less than $15\cdot10^{-4}$% and when the calcium content is less than $4\cdot10^{-4}$%, a very marked decrease in the number of coarse oxide inclusions with thickness greater than 10 μm is observed.

This application is based on French patent application 95 04 782 filed Apr. 21, 1995, incorporated herein by reference.

What is claimed as new and desired to be secured by Letters Patent of the United States is:

1. An austenitic stainless steel comprising by weight based on total weight:

carbon$\leqq 200\cdot10^{-3}$% nitrogen$\leqq 200\cdot10^{-3}$%

0.3%$\leqq$manganese$\leqq$4%

14%$\leqq$chromium$\leqq$23%

5%$\leqq$nickel$\leqq$17%, 0.3%$\leqq$silicon$\leqq$2%, sulfur$\leqq 10\cdot10^{-3}$%

$50\cdot10^{-4}$%$\leqq$total oxygen$\leqq 120\cdot10^{-4}$%, $5\cdot10^{-4}$%$\leqq$aluminum$\leqq 20\cdot10^{-4}$% magnesium$\leqq 2\cdot10^{-4}$%

$0.1\cdot10^{-4}$%$\leqq$calcium$\leqq 5\cdot10^{-4}$% titanium$\leqq 5\cdot10^{-3}$% and comprising oxide inclusions having, in the form of a vitreous mixture, the following proportions by weight:

40%$\leqq SiO_2 \leqq$60%

5%$\leqq$MnO$\leqq$50%

1%$\leqq$CaO$\leqq$30%

0.1%$\leqq$MgO$\leqq$20%

3%$\leqq Al_2O_3 \leqq$25%

0.1%$\leqq Cr_2O_3 \leqq$10%.

2. The steel as claimed in claim 1, comprising less than $5\cdot10^{-3}$ wt % of sulfur.

3. The steel as claimed in claim 1, further comprising less than 3 wt % of molybdenum.

4. The steel as claimed in claim 1, further comprising less than 3 wt % of copper.

5. The steel as claimed in claim 1, which contains in number, after hot rolling to a diameter of greater than 5 mm, fewer than 5 oxide inclusions of thickness greater than 10 μm for a surface area of 1000 $mm^2$.

6. The steel as claimed in claim 1, which contains in number, after hot rolling to a diameter of greater than 5 mm, fewer than 10 sulfide inclusions of thickness greater than 5 μm for a surface area of 1000 $mm^2$.

* * * * *